United States Patent [19]

Currie

[11] 4,309,892

[45] Jan. 12, 1982

[54] CRIMPING MACHINE

[75] Inventor: William E. Currie, Cleveland Heights, Ohio

[73] Assignee: Parker-Hannifin Corporation, Cleveland, Ohio

[21] Appl. No.: 145,158

[22] Filed: Apr. 30, 1980

[51] Int. Cl.[3] ..... B21D 41/04

[52] U.S. Cl. ..... 72/402; 29/237

[58] Field of Search ..... 72/402, 453.01, 453.18; 29/237

[56] References Cited

U.S. PATENT DOCUMENTS

| | | | |
|---|---|---|---|
| 3,335,594 | 8/1967 | Peterman | 72/402 |
| 3,720,088 | 3/1973 | Pauly | 72/402 |
| 3,742,754 | 3/1973 | Jeromson | 72/402 |
| 3,750,452 | 8/1973 | Frank | 72/402 |
| 3,851,514 | 12/1974 | Chen | 72/402 |
| 4,034,592 | 7/1977 | Chen | 72/402 |
| 4,034,593 | 7/1977 | Patel | 72/402 |
| 4,071,936 | 2/1978 | Smith | 29/237 |

*Primary Examiner*—Gene P. Crosby

*Attorney, Agent, or Firm*—Joseph B. Balazs

[57] ABSTRACT

A crimping machine has a rockable hydraulic cylinder which in a force transmitting position drives a die segment assembly into a tapered cavity to force the assembly to contract radially for crimping the socket of a fitting onto the end of a hose. The die segment assembly is a unitary chain of linked die segments which may be fed into and removed from the die cavity in a serial manner to avoid obstructions. A floating die separator with axial projections engages angular surfaces on the bottom of the die segments to position the segments prior to crimping in a circular array which is equally circumferentially and radially outwardly spaced.

20 Claims, 14 Drawing Figures

CRIMPING MACHINE

BACKGROUND OF THE INVENTION

This invention relates to a machine for crimping the socket of a fitting onto a hose end by the radial contraction of a segmented die assembly and more particularly to improvements in the segmented dies and assembly whereby use of the machine is facilitated. This apparatus is particularly suited for makeup of flexible hose assemblies of various sizes at a field location. In this regard it is desirable to have a machine which may be readily converted from one size to another for the construction of fluid pressure assemblies of different flow and pressure capacities, which machine performs the crimping of the fitting onto the hose end in an expedient and highly reliable manner. It is also desirable that the machine be designed to reduce the possibility of errors or malfunctions in the hose assembly due to the selection of improper components for a particular size or due to errors in the operation of the machine. Still further it is desired that the machine be versatile so as to accommodate not only the straight end fitting which may not require more than a partial operating cycle of the machine but also that of the bent hose end fitting which may require the full operating cycle and partial disassembly of the machine in order to place the components in position to perform the crimping action.

Field crimping devices are well established in the prior art for rapidly, economically and consistently making quality hose assemblies. They are capable of achieving high hose assembly standards comparable to factory constructed assemblies. Their ready availability, however, necessitates design and operating characteristics which provide minimal chance for error in makeup of hose assemblies.

One group of prior art devices are those series of machines disclosed in U.S. Pat. Nos. 3,720,088, 3,742,754, 3,750,452 and 3,851,514. This type of equipment relates to bottom-loading crimper devices, that is machinery in which the hose end, with hose fitting to be attached, is presented to the crimping machine from a position beneath the machine. This has the advantage that the components and most of the sequence of action during crimping are viewable and accessible by the operator of the machine, and importantly, that relatively heavy and bulky hose assemblies may be supported on the floor with only one end presented to the machine. In many instances the hose assembly may be held in location by the operator with a single hand leaving the other free for operation of fluid valves and the like. In equipment of this type a hydraulic cylinder situated generally over the crimping stage produces a linearly directed force upon a radially contractible die assembly which is received in the tapered bore of a base plate or other reaction body member opposing the force of the cylinder. Linear movement of the die assembly into the tapered bore causes a camming or wedging action upon individual segments collectively forming the die assembly, to cause movement of the segments in a radially inward direction such that an inner cylindrical surface thereof receiving the socket of the hose fitting is reduced in diameter, thereby effecting the crimping action.

The machinery exemplified in the above-identified patents is characterized in particular in that the preferred collet assembly consists of a pair of collet segment halves which may be placed in position in the tapered bore with the inner cylindrical surface thereof in engagement with the collar of the hose fitting. The hose and fitting may be raised or shifted somewhat by the operator to settle the die segment halves into a matching configuration in the machine with the segment halves then being retained therein primarily by the force of gravity but also assisted to some extent by the weight of a spacer plate which is positioned thereover. The spacer plate is designed primarily to spread the force of the hydraulic ram and assure even movement of both halves of the die collet but serves as well as to limit the linear movement of the hydraulic ram and thus the radial contraction of the individual collet segments. The preferred form of die collet arrangement of these prior art devices is shown in detail in U.S. Pat. No. 3,750,452 wherein it is seen that elastomeric material is disposed between adjacent die segments in a split collet arrangement. The elastomeric material retains each of the die segments in each half of the collet and provides a spacing of the collet halves once they are placed in the tapered bore, preparatory to the crimping operation. The half collet arrangement is particularly advantageous in providing ease of loading and preparation of the machine and a facility for clearance of obstructions, as for example, those encountered when crimping bent hose ends.

Still further forms of the same line of equipment are shown in U.S. Pat. Nos. 4,034,592 and 4,034,593 where in similar crimping machines there are described improvements primarily in the support of the collet halves to facilitate the locating of same in the tapered die cavity automatically in each cycle of the crimping operation. These improvements in the placement of the collet halves free the operator for the functions of placement of the hose assembly in location, and for operation of fluid valves and the like and results in a speeding of the operating cycle of the machine.

Still another prior art approach is shown in U.S. Pat. No. 3,335,594, this being a top loading form of crimping machine wherein the preassembled hose with end fitting thereon is inserted from the top of the machine, to be acted upon in the crimping operation by the similar components of a linearly acting hydraulic ram and a plural die segment assembly operative to effect radial crimping by cooperation with the sides of a tapered cavity upon axial movement developed by the hydraulic ram. In this crimping device the die segments are separate and supported in the radial slots of a common die carrier which positions the die segments in a tapered die cavity. The necessary relative movement therebetween is effected by the upward movement of the block containing the die cavity under the urging of the hydraulic ram. Bent hose ends are accommodated as well in this form of structure, being limited primarily by the size of the throat of the die segment support member to which diameter the die segments can be retracted. In fact, in this machine the die segments can be fully removed from the support member. Final crimp diameter is determined by a visual gage device which must be judged by the operator to manually terminate the application of hydraulic force to the actuating ram.

In this form of device, different final crimp diameters may be achieved by alteration of the final stop position of the linearly acting pusher mounted on the piston. However, in any such machine the range is limited and it is necessary to substitute different die segments for various size ranges. It is necessary to assure that compatible die segments are being utilized to perform the crimping operation in order to obtain satisfactory connection between the end fitting and the hose.

This problem has been recognized in the past and one solution thereto is disclosed in U.S. Pat. No. 4,071,936 wherein each of the die segments in the die segment assembly is joined to two adjacent die segments by means of intermediate spring members such that the segments are always retained in the proper assembly. The limitation on devices of this type however is that only a certain expanded inside diameter of the die segment assembly can be attained dependent upon the resiliency of the intermediate springs and the size of the segments. A further detriment is that the entire assembly must be disposed over a bent hose end by stretching the unit and sliding the assembly over the hose end. To achieve expansion of the assembly and to support same during this maneuver it is necessary that the operator use both hands since die segment assemblies typically weigh on the order of upwards of five to ten pounds. It is apparent that some assistance would be required in holding the hose assembly in a prepartory position and in positioning and aligning the die segment members in this manner.

SUMMARY OF THE INVENTION

The apparatus of the instant invention is advantageous in several respects over prior art devices in that the individual die segments are linked to one another except at one location to provide a flexible chain. Further, the die segments are supported in an advantageous manner in a tapered die cavity to facilitate operation of the machine.

In a preferred embodiment of this invention the crimping machine comprises a bottom-loading type machine consisting of a rockably mounted overhead hydraulic cylinder which provides a downwardly directed force to drive the die segment assembly into a tapered cavity in a base plate to achieve the radially inwardly directed crimping action.

The hydraulic cylinder is rockable to provide clearance over the tapered cavity for loading and unloading purposes and is automatically guided through a rocking motion by the cooperation of cam rollers carried by the pusher with a fixed cam plate. The cam arrangement is designed to provide a linear motion of the pusher during one portion of its stroke and the rocking motion when the piston rod reaches the position of near full retraction. In this manner, only a short outer portion of the stroke need be utilized when repetitive crimps of straight end fittings are desired and the hose assemblies can be inserted and removed by merely retracting the die segments. When, however, bent end fittings are to be made or the die segment assembly is to be changed, then the pusher can be fully retracted and swung away from the work area to provide suitable clearance.

The chain of die segments in a unitary assembly assures that the proper combination of die segments will be utilized. Further, the chain of segments may be wrapped around the socket of a fitting in a serial manner, avoiding the requirement that such assembly be placed over the end of a fitting positioned in the die cavity. This has particular advantage with bent end fittings and in most instances allows the operator to support the hose assembly with one hand, and then use the other hand to install the die segments and operate the hydraulic mechanism.

The die segments of this invention are similar to prior art devices in having an outer surface consisting of a portion of a cone received in and complementary with the surface of a conical throughbore and an inner surface consisting of a portion of a cylinder for reducing the size of the cylindrical surface of a hose fitting socket. The die segments, however, include a novel bottom configuration of sloping surfaces which in cooperation with a die separator device supported within the die cavity provides both an equally circumferentially spaced circular array of the die segments and a radially outwardly positioned initial disposition suitable for receipt and positioning of the hose assembly therein.

DESCRIPTION OF THE INVENTION

Figure 1:
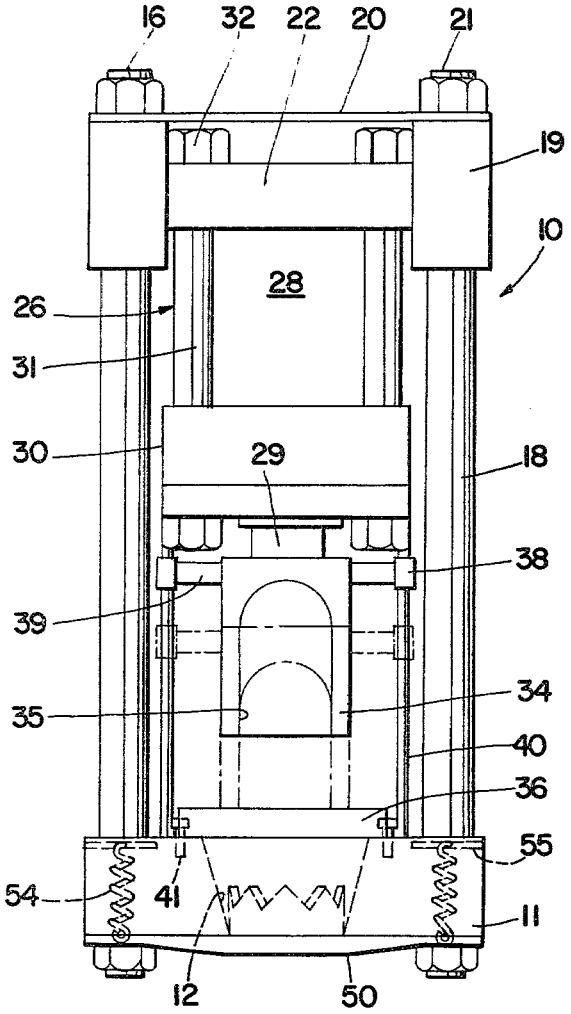
FIG. 1 is a front elevation view of the crimping machine with pusher elevated, showing a second, fully extended position of the pusher in dashed lines.
Figure 2:
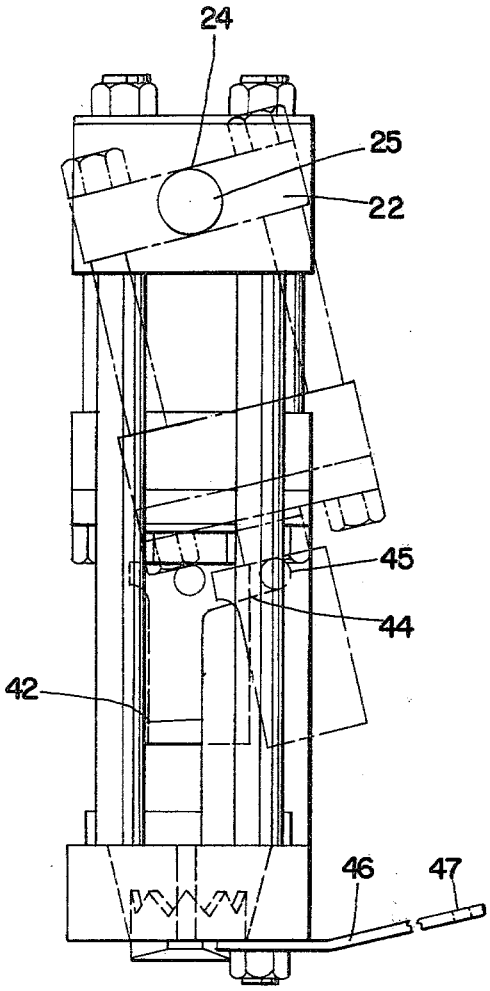
FIG. 2 is a side elevation view of the crimping machine with pusher elevated showing a rocked, fully retracted position of the pusher in dashed lines.

Referring initially to FIGS. 1, 2, 6 and 8, there is shown the crimping apparatus 10 of the invention and portions thereof, consisting in part of generally rectangular base plate 11 having a centrally located tapered throughbore 12 therein adapted for receipt of a die segment assembly 15 (not shown in FIGS. 1 and 2 for reasons of clarity). Base plate 11 is thus a die block with the throughbore 12 forming a die cavity therein of generally conical shape, having the larger opening at the upper surface 13 thereof for receipt of the die segment assembly 15. Base plate 11 is apertured at each corner for receipt of tie rods 16 which through apertures in turn in compression sleeves 18, trunnion caps 19 and cap plate 20, and are secured in tension by nuts 21. Generally rectangular cap plate 20, engaging each of the tie rods 16, serves to tie together the upper portion of the crimping machine 10.

An upper cylinder support 22 is pivotally mounted between trunnion caps 19 in aligned bearing apertures 24 by means of laterally extending trunnion pins 25. A hydraulic actuator 26 consisting of hydraulic cylinder 28 and linearly movable piston rod 29 is supported for movement with upper cylinder support 22 by means of lower support plate 30, tie rods 31, and nuts 32. Thus the hydraulic actuator 26 may be rocked between the normal forward crimping position shown in full lines in FIGS. 1 and 2 and the rearward clearance position shown in dashed lines in FIG. 2.

A pusher device 34 consisting of a generally cylindrical hollow member having an opening 35 in the forward portion thereof is secured to the piston rod 29 for movement therewith and is the device for transmitting force to the die collet assembly 15. A pair of cam followers 38 consisting of rollers mounted on transversely extending shafts 39 are supported on opposite sides of pusher 34 to guide movement thereof and are positioned to ride upon the forward cam surface of a pair of cam plates 40, in turn extending generally vertically and supported at either side of pusher 34 on base plate 11, by means of bolts 41. Each cam plate 40 comprises a sturdy metal plate having a straight cam surface 42 extending upwardly from the base plate 11 to a location slightly below the uppermost retracted position of the end of ram 29. The cam surface 42 then curves into a rearwardly and slightly upwardly extending ramp portion 44 at an angle of approximately 80° to the line of the straight cam surface 42, terminating in a further rearward and straight upward cam stop surface 45.

The cam followers 38 are positioned to ride along the cam surfaces of the plates 40 and in so doing guide the pusher 34, and the cylinder 28 therewith. When the cam followers 38 are in abutment with the straight cam surface 42, the pusher will be guided in a straight line between the line of the axis of the trunnion pins 25 and the center of base plate 11 at which tapered bore 12 is located, thus following the central axis of the bore 12. When in engagement with the ramp portion 44 the cam followers 38 will rock the pusher 24 and cylinder 28 between the full line and dashed line position shown in FIG. 2. Rearward movement of the cam followers 38 is limited by the cam stop surface portion 45.

While the crimping machine 10 is shown in a vertical disposition in FIGS. 1 and 2 and is capable of operation in this position in the manner described, it would be necessary to provide manual or spring force, for example, to rock the hydraulic actuator to the rearward position. In practice, it is preferred that the machine 10 is tilted at a slight rearward angle and bracket 46 secured to base plate 11 is provided for this purpose. The angled portion of bracket 46 may be mounted on a generally horizontal surface by means of bolts passing through aperture 47 to support the machine at an angle of about 15°. In such arrangement hydraulic actuator 26 will be urged by gravity toward the rearward position such that cam followers 38 will remain in contact with the cam surfaces of the cam plates 40 and be guided automatically between the full line and dashed line positions depicted in FIGS. 1 and 2 as the ram 29 is extended and retracted.

Figure 3:
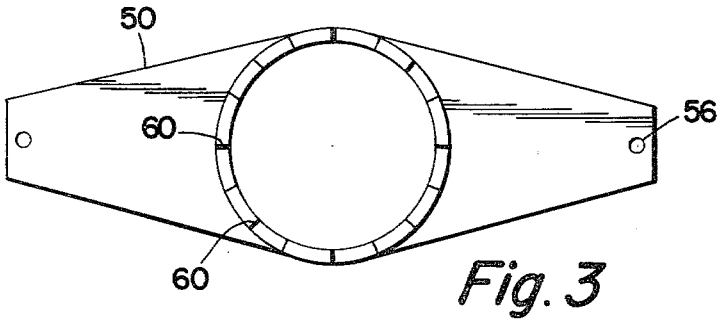
FIG. 3 is a plan view of the die separator.
Figure 4:
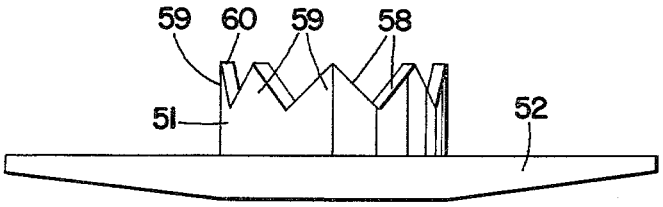
FIG. 4 is an elevation view of the die separator.
Figure 5:
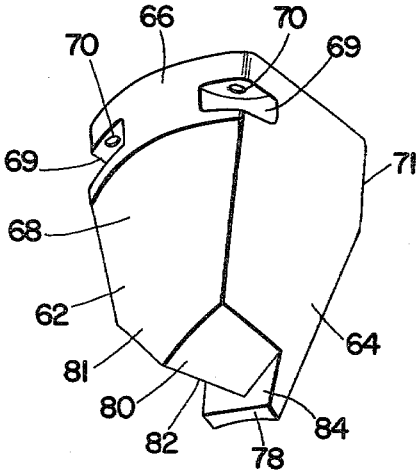
FIG. 5 is a perspective view of one of the die segments of the die assembly.

A die separator 50 comprises part of the crimping machine 10 and is shown in detail in FIGS. 3 and 4 as consisting of a tubular portion 51 integral with a generally flat, elongated mounting portion 52, extending from either side of the tubular portion 51 to span substantially the width of the base plate 11. The tubular portion 51 is of a diameter to freely fit within the smallest diameter of the tapered bore 12 and extends upwardly within the bore 12 approximately one-half the thickness of the base plate 11 when the mounting portion 52 is in engagement with the lower surface of the base plate 11.

The die separator 50 is guided for movement into and out of the tapered bore 12 by means of the tubular portion 51 and is secured to the base plate 11 for such floating movement by means of a pair of extension springs 54. The springs 54 are disposed in bores in the base plate 11, between front and rear tie rods 16, secured at upper ends by means of spring pins 55, and secured at the lower end by engagement with a web in apertures 56 at either end of mounting portion 52 of die separator 50. The die separator 50 is preferably a one-piece structure formed of glass filled nylon and has sufficient strength together with extension springs 54 to support the die segment assembly 15 within the tapered bore as will be described in greater detail.

The upper edge of the tubular portion 51 of the die separator 50 is a series of intersecting angled surfaces 58 forming generally triangular shaped, axially extending, tooth-like projections 59 for support of the die segment assembly 15. In this embodiment of the invention, eight equally spaced projections 59 form the upper surface of the tubular portion 51, the surfaces 58 being flat and intersecting in a series of eight linear ridges 60, directed radially inwardly, at the tips of the projections 59, the ridges 60 being horizontal or tipped slightly upward toward the center.

Figure 6:
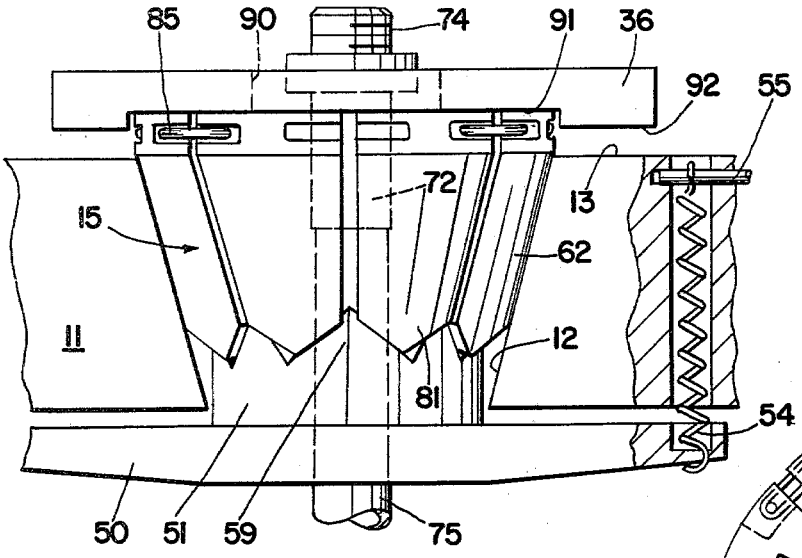
FIG. 6 is a side view of a portion of the crimping machine partly in section, showing the die segment assembly in an open position preparatory to crimping.
Figure 7:
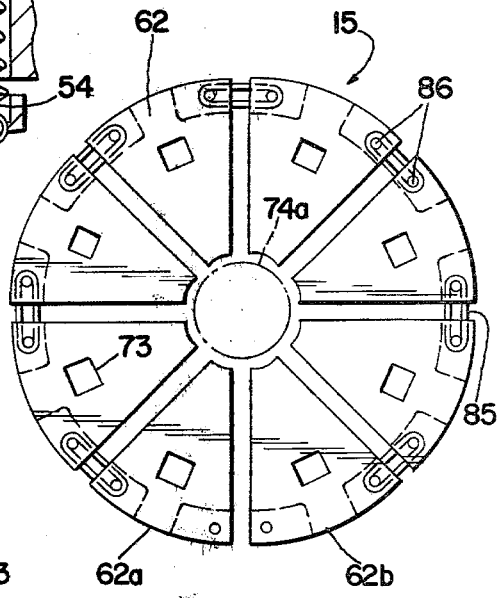
FIG. 7 is a plan view of the die segment assembly of FIG. 6.
Figure 8:
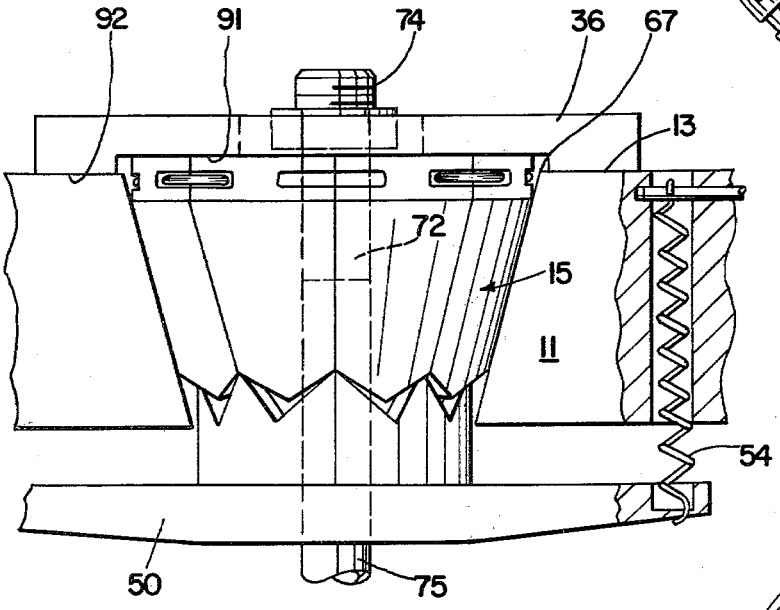
FIG. 8 is a side view similar to that of FIG. 6, showing the die segment assembly in a contracted position upon completion of crimping.

The portion of the crimping machine 10 containing die segment assembly 15 is seen in greater detail in FIGS. 6 and 8 with the die segment assembly shown separately in FIGS. 7, 9, 12 and 13. Views of a single die segment 62 comprise FIGS. 5, 10, 11 and 14.

The die segment assembly 15 consists of eight identical die segments 62 which when positioned adjacent one another comprise a circular array of the segments 62. Each segment 62 consists of a block of cast steel in a generally pie-shaped configuration having a pair of flat sides 64 lying in radial planes which intersect in coincidence with the central axis of the die segment assembly 15 in its closed position (FIG. 9), and which are separated by an angle of 45°. The radial outer surface of each die segment is a curve intersecting the sides 64 and consists of an upper cylindrical portion 66 and a lower conical portion 68, the latter of a shape matching the tapered throughbore 12 of base plate 11. A pair of slots 69 are included in each of the corner intersections of cylindrical segment 66 and the sides 64 while holes 70, generally parallel with the central axis of the die segment assembly 15 are drilled through the body of the segments 62, passing through the slots 70.

Each die segment 62 further includes an inner cylindrical surface 71 parallel to the central axis and generally conforming to the shape of the socket 72 of a fitting 74 to be assembled to a hose 75. The inner surface 71 is adapted to contact the socket 72 to perform the crimping upon the latter and may be shaped in different configurations to provide any desired indentation of the socket 72. The upper surface 76 of the die segment is flat and perpendicular to the central axis of the assembly and intersects the inner and outer cylindrical surfaces 71 and 66 and the flat sides 64. A flat lower surface 78 is parallel to upper surface 76 and is joined to inner surface 71 by a fan-shaped, upwardly angled conical segment surface 79. The bottom of each die segment 62 is further configured by a pair of inclined flat surfaces 80, angled generally circumferentially of the die segment assembly 15 to form a vee-shaped bottom projection 18 on each segment, and inclined radially upwardly to form the upwardly and inwardly sloping ridge 82 joining the outer wall 68 and a generally cylindrical lower wall 84.

Figure 9:
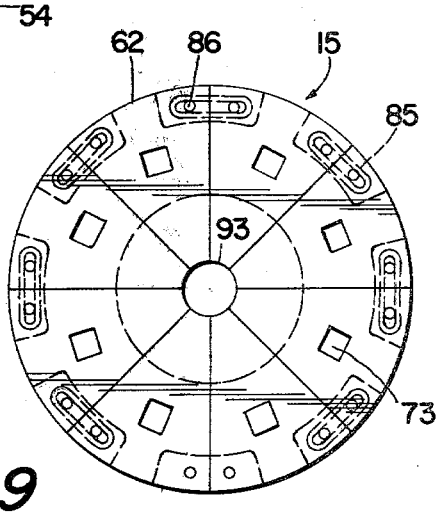
FIG. 9 is a plan view of the die segment assembly of FIG. 8.
Figure 10:
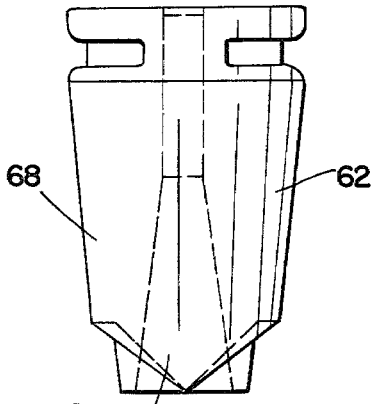
FIG. 10 is an end view of one of the die segments.
Figure 11:
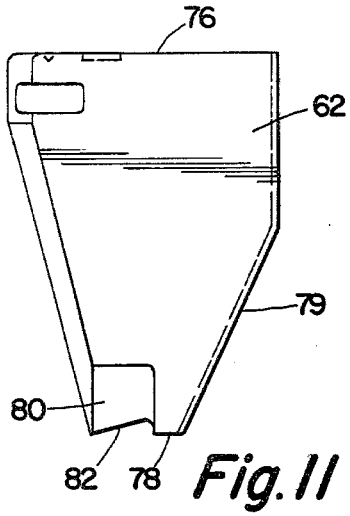
FIG. 11 is a side view of one of the die segments.
Figure 12:
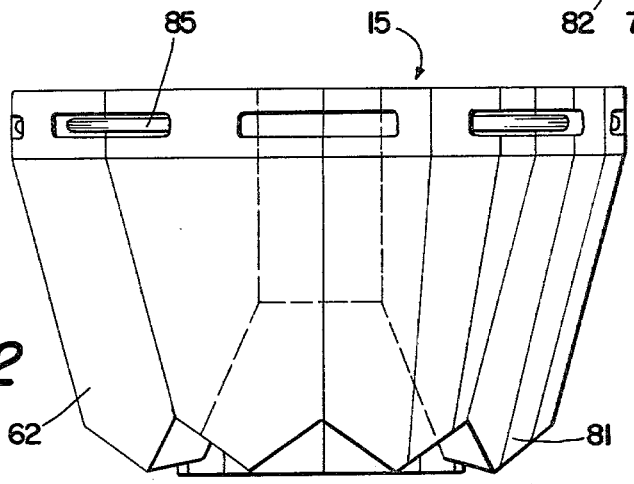
FIG. 12 is a side view of the die segment assembly in the contracted position, removed from the crimping machine.
Figure 13:
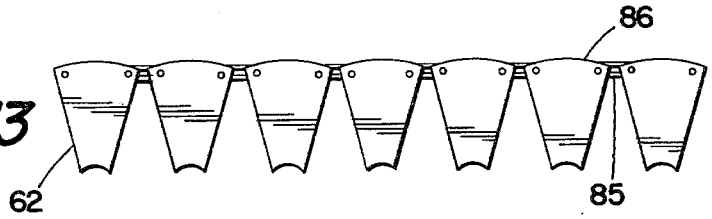
FIG. 13 is another plan view of the die segment assembly shown removed entirely from the machine and in a straight chain configuration.
Figure 14:
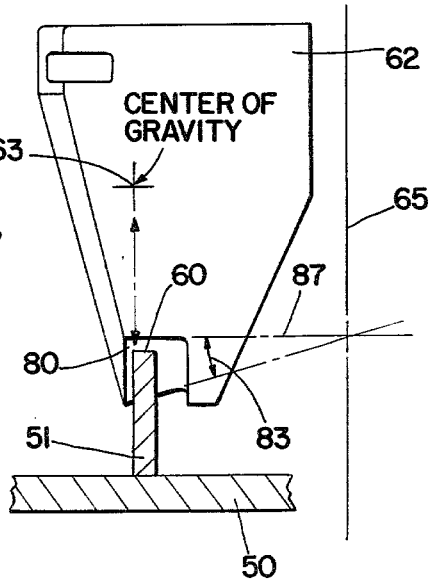
FIG. 14 is an enlarged side view of one of the die segments and a portion of the die separator shown in relation to an imaginary centerline for curved surfaces of the die segment and the throughbore in the base plate of the crimping machine.

With this configuration of die segment 62 it is relatively easy to provide a die segment assembly 15 of any desired size range. The die segments 62 may be assembled into an array as shown in FIG. 9, retained in place, and then drilled or bored along the central axis of the array to form the desired inner surfaces 71. An increased axial extent of inner surface 71 for larger diameter sizes is thus automatically provided by the point of intersection of surface 71 with angled conical surface 79.

As best seen in FIGS. 7 and 9, each die segment 62 is connected to an adjacent die segment 62 by means of an intermediate rigid link 85 consisting of an elongated metal loop disposed in adjacent slots 69 and pivotally secured in place by means of spring type link pins 86 pressed into drilled holes 70. Two adjacent die segments **62*a*, 62*b* are not linked together and thus form the first die segment 62*a*, and last die segment 62*b*, with intermediate die segments 62 in a unitary chain of die segments comprising the die segment assembly 15. An indentation 73 of a particular shape is included in the top surface 76 of each die segment 62 as a device for coding the die segment assembly 15**.

It will be apparent then, that when a hose assembly is to be formed the following sequence occurs, having reference primarily to FIGS. 6–9. A preassembled hose 75 having end fitting 74 thereon may be inserted from the bottom of the crimping machine 10 through the tubular portion 51 of die separator 50 to approximately the location shown in FIG. 6. Die segment assembly 15 may then be dropped into the tapered bore 12 in base plate 11, being wrapped about the collar 72 of hose fitting 74 and resting upon die separator 50. Vee-shaped projections 81 of each die segment 62 will enter between the vee-shaped projections 59 of separator 50 such that the respective angled surfaces 80, 58 forming the projections, will interengage, spreading the individual die segments with equal spacing between them. Springs 54 are sufficiently strong to retain the die segments in the position depicted in FIGS. 6 and 7 with the die segments 62 separated and out of contact with the collar 72 of hose fitting 74 as shown in dashed lines **74*a*. The center of gravity (indicated at 63) of each die segment 62 is at a greater distance from the centerline 65 of the tapered throughbore 12 than the inner end of the ridges 60, so that the die segments 62 are urged by gravity to fall outward against the intersection 67 of throughbore 12 and the upper surface 13 of base plate 11. In addition, the angle 83 between the bottom ridge 82 and the horizontal (indicated at 87) is greater than the angle of repose for the contacting plane surfaces 58 and 80, so that the die segments 62 are urged by gravity to slide outward against the throughbore 12. In their final position, the chain of die segments 62 are evenly spaced and fully retracted solely through the force of gravity. When the machine 10 is tilted at a rearward angle of about 15°, as preferred, a pusher plate 36 having central aperture 90 therein may be placed over fitting 74 such that flat recessed surface 91 engages the top surfaces 76 of the die segments 62, further assuring vertical alignment and even spacing of the die segments 62, preparatory to crimping. The lower surface 92 of pusher plate 36 is separated in this preliminary position from the upper surface 13 of base plate 11**.

FIGS. 8 and 9 depict the condition of the elements upon completion of the crimp. In attaining this position pusher plate 36 had been engaged by pusher 34 and driven downwardly under urging of the hydraulic actuator 26, forcing the die segments 62 further downward into the tapered bore 12 and constricting same to a radial inward position. In such motion the inner surfaces 71 of the die segments 62 engaged the socket 72 of the hose fitting 74 and compressed same onto the end of inserted hose 75, until the final crimped diameter 93, depicted in FIG. 9, was attained. Although die segments 62 may have adjacent faces 64 in engagement at this location, some spacing is normally provided, with the crimp diameter 93 being determined by the abutment of lower surface 92 of pusher plate 36 with the top surface 13 of base plate 11, this being the second or crimp position of the die assembly 15. Further, during the crimping motion, die separator 50 has been forced downwardly against the bias of springs 54 to a position where surface portion 52 is spaced from the lower surface of base plate 11. Upon release of force by return of the pusher 34 to a retracted position, die segments 62 will be urged upwardly to the circumferentially and radially spaced position depicted in FIG. 6 under the urging of springs 54.

It will be apparent that with straight end fittings such as that shown at 74, a limited cycle of the crimping machine 10 may be employed whereby the cam follower 38 need not leave first straight surface 42 of cam plate 40 as the pusher plate 36 and die segments 62 may be lifted sufficiently to provide central clearance for passage of the preassembled and completed crimped hose fitting.

However, with bent end fittings and with larger size straight fittings it may be necessary to completely remove the pusher plate 36 and die segments 62 and in this instance it is advantageous to fully retract the hydraulic ram 29 to the dashed line position shown in FIG. 2 whereby greater access is provided at the top of the tapered bore 12. This remote position of the ram is also desirable when changing the entire chain of die segments 62 for crimping of different size end fittings.

What is claimed is:

1. A crimper assembly for crimping the socket of a hose fitting onto a hose end within a die block having a tapered bore therein comprising, a plurality of die segments for crimping the socket of a hose fitting, said die segments having an outer surface conforming to the bore of said die block and an inner surface for crimping said hose fitting, means connecting adjacent die segments for limited relative movement to facilitate placement and removal of said die segments to and from said die block, said die segments being positioned in said die block in a circular array adapted to encircle the socket of a hose fitting positioned therein, a die separator, means for permitting axial movement of the die separator relative to said die segments, said die separator supporting said die segments in said die block in a first position therein adapted for receipt of said hose fitting, said die separator engaging each of said die segments to position same in a symmetrical and spaced circular array, and means for urging said die segments simultaneously into said die block with said outer surface in engagement with said tapered bore.

2. The crimper assembly set forth in claim 1 wherein all of said die segments are secured by said connecting means to form a die segment assembly movable as a unit into and out of said die block.

3. The crimper assembly set forth in claim 2 wherein said die segment assembly is a die segment chain having first, last and intermediate die segments, said first die segment being separate from said last die segment so that said die segment chain may be placed in or removed from said die block without intersection of the central axis of said tapered bore therein.

4. The crimper assembly set forth in claim 2 wherein said die segment assembly is a die segment chain having one die segment free of connection to a second die segment whereby said first and second die segments and all die segments intervening between said first and second die segments may be positioned or removed from said die block, seriatim.

5. The crimper assembly set forth in claim 3 or claim 4 wherein said die segment assembly comprises eight die segments, six of said die segments being joined by said connecting means to two adjacent die segments.

6. The crimper assembly set forth in claim 1 wherein each said die segment includes an angled surface on the bottom portion thereof engageable with said die separator for camming said die segment relative to said die separator.

7. The crimper assembly set forth in claim 6 wherein said angled surface is angled circumferentially and said die separator includes angled surfaces thereon cooperative with said angled surface of said die segments to cam said die segments circumferentially.

8. The crimper assembly set forth in claim 7 wherein said angled surfaces on said die separator are equally spaced to cam said die segments into equally spaced circumferential positions.

9. The crimper assembly set forth in claim 6 or 8 wherein said angled surface on each said die segment is angled radially inwardly and upwardly so that each said die segment is cammed outwardly into engagement with the surface of said die block forming said tapered bore, to urge said die segments into outwardly spaced positions relative to one another.

10. The crimper assembly set forth in claim 1 wherein each said die segment includes a pair of angled surfaces on the bottom portion thereof and said die separator includes angled surfaces wherein said angled surfaces on said die segments and said die separator comprise vee-shape surfaces which interengage each other.

11. The crimper assembly set forth in claim 10 further including spring means mounting said die separator to said die block for movement relative thereto, said die separator being movable with said die segments in response to said urging means.

12. The crimper assembly set forth in claim 6 wherein said urging means comprises a hydraulic actuator reciprocable toward and away from said die block and a pusher plate disposed between said actuator and said die segments for evenly distributing the force of said actuator, said pusher plate being engageable with said die block to provide an end limit position thereof and having a recess therein in engagement with said die segments to provide an end limit position of said die segments in said die block and thus determine the end crimp diameter of said die segments.

13. The die assembly set forth in claim 12 wherein said hydraulic actuator is mounted for pivotal movement away from said die block to provide additional clearance for removal of said die segments, said pusher plate and hose fittings from the tapered bore of said die block.

14. A crimping machine for radially deforming the socket of a fitting onto the end of a hose, comprising a support member having a tapered cavity therein, a generally circular die segment assembly in said cavity for engaging the socket of a fitting positioned therein and for radially inwardly deforming said socket and means for moving said die segment assembly axially relative to said support member thereby to force said die segment assembly radially inwardly, said die segment assembly comprising a plurality of generally pie-shaped die segments, each die segment having a pair of radial walls, an outer wall having a generally conical curvature conforming to the shape of the tapered cavity in said support member, said outer wall meeting said radial walls, an inner wall having a generally axially-extending cylindrical curvature adapted to conform generally to the outer surface of the socket of a fitting, said inner surface joining said radial walls, and means for supporting said die segment assembly in said cavity in a circumferentially equally-spaced configuration comprising a tubular member having a series of equally spaced axially extending projections thereon, each said die segment having a further seating surface between said radial walls and said inner and outer walls adapted for engagement with one or more of said projections, and means urging all of said die segments into contact with said tubular member to cause seating engagement therebetween and an equally spaced positioning of said die segments in a circular configuration.

15. The crimping machine set forth in claim 14 wherein said seating surface of each said die segment comprises angularly inclined surfaces adapted for engagement with adjacent projections of said tubular member.

16. The crimping machine set forth in claim 15 wherein said projections are vee-shaped and said angularly inclined surfaces intersect in a vee configuration.

17. The crimping machine set forth in claim 16 wherein said inclined surfaces are further radially inwardly inclined to urge each said die segment radially outwardly.

18. The crimping machine set forth in claim 14 wherein said urging means comprises gravity.

19. The crimping machine set forth in claim 14 wherein each said die segment comprises a further surface between said radial surfaces and said inner and outer surfaces and said urging means comprises a plate in engagement with said further surfaces to urge said die segments simultaneously into said tapered cavity.

20. The crimping machine set forth in claim 19 wherein said urging means further comprises a hydraulic actuator, said plate being disposed between said die segments and said actuator, said plate being adapted to engage said support member for limiting movement of said actuator and thus the end crimp diameter of said die segment assembly.

* * * * *